US009297129B1

(12) United States Patent
Eriksen

(10) Patent No.: US 9,297,129 B1
(45) Date of Patent: Mar. 29, 2016

(54) SAFETY GUARDRAIL

(71) Applicant: Supreme Safety Guardrail, Inc., Denville, NJ (US)

(72) Inventor: Olof A. Eriksen, Cedar Knolls, NJ (US)

(73) Assignee: Supreme Safety Gaurdrail, Inc., Denville, NJ (US)

( * ) Notice: Subject to any disclaimer, the term of this patent is extended or adjusted under 35 U.S.C. 154(b) by 0 days.

(21) Appl. No.: 14/636,643

(22) Filed: Mar. 3, 2015

(51) Int. Cl.
*E01F 15/04* (2006.01)
*E01F 15/02* (2006.01)

(52) U.S. Cl.
CPC ..... *E01F 15/0423* (2013.01); *E01F 15/02* (2013.01); *E01F 15/0407* (2013.01)

(58) Field of Classification Search
CPC ..... E01F 15/02; E01F 15/04; E01F 15/08; E01F 15/06; E01F 15/0461; E01F 15/0423; E01F 15/143; E01F 15/025; E01F 15/0438; E01D 19/00; E01D 19/10
USPC ..... 404/6; 256/13.1
See application file for complete search history.

(56) References Cited

U.S. PATENT DOCUMENTS 4,678,166 A 7/1987 Bronstad et al.
4,838,523 A 6/1989 Humble et al.
4,928,928 A * 5/1990 Buth ..... E01F 15/143 188/377
5,078,366 A * 1/1992 Sicking ..... E01F 15/143 188/377
5,391,016 A * 2/1995 Ivey ..... E01F 15/143 256/13.1
5,490,661 A 2/1996 Stevens et al.
5,503,495 A 4/1996 Mak et al.
5,547,309 A 8/1996 Mak et al.
5,931,448 A 8/1999 Sicking et al.
5,957,435 A 9/1999 Bronstad
5,988,598 A * 11/1999 Sicking ..... E01F 9/0182 256/1
6,022,003 A * 2/2000 Sicking ..... E01F 15/143 256/13.1
6,089,782 A * 7/2000 Bligh ..... E01F 15/143 404/6
6,129,342 A 10/2000 Bronstad
6,254,063 B1 7/2001 Rohde et al.
6,299,141 B1 10/2001 Lindsay et al.
6,575,434 B2 6/2003 Bligh et al.
6,715,735 B2 * 4/2004 Bligh ..... E01F 15/143 256/13.1
6,783,116 B2 * 8/2004 Albritton ..... E01F 15/143 256/13.1
7,980,533 B1 * 7/2011 Anderson ..... E01F 9/0182 256/13.1

(Continued)

*Primary Examiner* — Abigail A Risic
(74) *Attorney, Agent, or Firm* — Graham Curtin, P.A.

(57) ABSTRACT

Provided is a cost effective apparatus that can be attached to a preexisting guardrail end terminal infrastructure to gradually decelerate a vehicle, after a collision, in a controlled manner to prevent the guardrail from impaling the vehicle and the projection of debris on the highway. The safety guardrail comprises a front plate having an anterior surface and posterior surface. One or more support plates are connected to the posterior surface of the front plate. The safety guardrail also comprises one or more four-walled non-linear diverters defining a path between an open anterior end and open posterior end, the one or more diverters connected to the one or more support plates. One or more guardrails having an anterior end and a posterior end, the anterior end of one or more guardrails located inside the path of the diverter. One or more posts are distributed in a first plane, the first post in the plane having a top part connected to the one or more diverters and the one or more support plates. The anterior end of the one or more diverters flare in a direction away from the first plane. Two or more guardrail layers may be positioned parallel to the first plane and are connected parallel to one another, and at least one of the guardrails is located inside the path of the diverter. Also provided is a method of installing the apparatus to existing highway infrastructure.

7 Claims, 21 Drawing Sheets

(56) References Cited

U.S. PATENT DOCUMENTS

2003/0034484 A1* 2/2003 Buth ..... E01F 15/143
256/13.1

2008/0272352 A1* 11/2008 Gripne ..... E01F 15/025
256/13.1

2009/0272956 A1* 11/2009 Abu-Odeh ..... E01F 15/143
256/13.1

* cited by examiner

SAFETY GUARDRAIL

BACKGROUND

The present invention relates to guardrail safety systems in general, and more particularly to guardrail safety systems capable of safely decelerating a vehicle that impacts a guardrail end terminal.

Guardrails are provided along many highways to protect drivers and passengers from hazards, such as trees, cliffs, and overpass stanchions, that can cause injury or death if a vehicle were to veer off the road. The end of the guardrail, however, can itself be a hazard when a vehicle impacts the terminal end of a guardrail. Such a collision can result in the vehicle being impaled by various parts of the end terminal system, such as the guardrails and posts. This can, and has, resulted in catastrophic bodily injury or death to drivers and passengers of vehicles. In fact, there have been reported cases of guardrails piercing straight through the full length of a vehicle after a collision. See, e.g., Aaron M. Kessler, *Critical Tests to Begin on Highway Guardrail Banned in Most States*, N.Y. Times, Dec. 9, 2014, available at http://www.nytimes.com/2014/12/10/business/critical-tests-to-begin-on-highway-guardrail-banned-in-most-states.html? r=0. Furthermore, the force of a collision with the end of a guardrail can project vehicle and guardrail debris onto the highway that create the possibility for peripheral accidents and injuries.

Various guardrail end terminals have been designed to ameliorate the risks of a collision by decelerating the vehicle and controlling the expulsion of guardrail and vehicle parts into adjacent highway traffic. Many of these conventional "safe" guardrail end terminals have been installed along highways around the country. Unfortunately, the safety mechanisms of conventional guardrail end terminals fail regularly on impact, resulting in hundreds of people each year being maimed or killed by parts of a guardrail piercing the vehicle, or by parts of a guardrail being ejected into highway traffic. As a result, more than 30 different states in the U.S.A. have banned one conventional guardrail end terminal which has been determined to be unsafe. Id.

Compounding the difficulties of improving the safety of guardrail end terminals is the fact that there is a substantial amount of infrastructure already in place. As a result, the cost of fully replacing installed faulty guardrail end terminals with an entirely new system may be prohibitively expensive.

There is a clear need for an improved design for guardrail end terminals that more consistently and effectively protect highway travelers, while also being economically feasible to implement.

SUMMARY OF THE INVENTION

One aspect of the present invention is directed to a cost effective apparatus that can be attached to a preexisting guardrail end terminal infrastructure to gradually decelerate a vehicle, after a collision, in a controlled manner to prevent the guardrail from impaling the vehicle and the projection of debris on the highway.

In one or more embodiments, the safety guardrail comprises a front plate having an anterior surface and posterior surface. One or more support plates are connected to the posterior surface of the front plate. The safety guardrail also comprises one or more four-walled non-linear diverters defining a path between an open anterior end and open posterior end, the one or more diverters connected to the one or more support plates. One or more guardrails having an anterior end and a posterior end, the anterior end of one or more guardrails located inside the path of the diverter. One or more posts are distributed in a first plane, the first post in the plane having a top part connected to the one or more diverters and the one or more support plates. The anterior end of the one or more diverters flare in a direction away from the first plane.

In other embodiments, two or more guardrail layers are positioned parallel to the first plane and are connected parallel to one another, and at least one of the guardrails is located inside the path of the diverter.

Some embodiments of the safety guardrail further comprise one or more additional posts having a top part connected to the one or more guardrails. The one or more additional posts are distributed sequentially in the first plane, with the first post closest to the front plate. At least one or more guardrails span the distance between the one or more additional posts.

In yet other embodiments, the safety guardrail may comprise a second, third, and fourth post having a top part connected to the one or more guardrails. The first, second, third, and fourth post are distributed sequentially in the first plane, with the first post closest to the front plate and the fourth post furthest from the front plate. At least three guardrail layers span the distance between fourth post and the third post, at least two guardrail layers span the distance between the third post and the second post, and at least one guardrail layer spans the distance between the second post and the first post.

In some embodiments of the safety guardrail, the posterior end of one or more diverters has a tapered edge adapted to shearing fasteners.

In some embodiments, the safety guardrail may comprise a three sided coupling, the three sides of the coupling defining an interior area adapted to embrace the one or more posts. The one or more posts are at least partially underground, and the top half and bottom half of the one or more posts is not a continuous piece of material. The top half and the bottom half of the one or more posts are held together by the coupling. The bottom half of the one or more posts is affixed to the coupling by one or more fasteners having a first strength, and the top half of the one or more posts is affixed to the coupling by one or more fasteners having a second strength, the first strength being less than the second strength.

In other embodiments, the safety guardrail may comprise one or more tube shaped spacers positioned between the one or more post and the one or more guardrails, wherein the one or more tube shaped spacers have sharp edges adapted to shear a fastener.

In one or more embodiments, the safety guardrail may comprise a front plate having a left edge and a right edge that flare out from the main body of the front plate in a direction away from the one or more support plates.

In one or more embodiments, the safety guardrail may comprise at least one diverter and one series of tiered guardrails, connected to the first, second, third, and fourth posts on each side of the first plane, each of the diverters flaring in a direction opposite to each other. The diverters have a structural strength capable of withstanding deformation while at least three layers of guardrail are forced through the path between the open anterior end and the open posterior end.

One or more embodiments of the safety guardrail may comprise a coupling having a first flat part, a second flat part and a third flat part, the first flat part being perpendicularly connected to the second flat part, the second flat part being perpendicularly connected to the third flat part, the first flat part and third flat part being oriented parallel to each other. The first flat part is connected to the posterior side of the top part of the one or more posts and the third flat part is connected to the anterior side of the bottom part of the one or more posts. The one or more posts are at least partially underground, and the top half and bottom half of the one or more posts is not a continuous piece of material. The top half and the bottom half of the one or more posts are held together by the coupling. One or more rectangular bumpers may be attached to the posterior side of the top part of the one or more posts. The bottom part of the one or more posts may be affixed to the third flat part of the coupling by one or more fasteners having a first strength, and the top half of the one or more posts may be affixed to the first flat part of the coupling by one or more fasteners having a second strength, the first strength being less than the second strength.

Another aspect of the present invention is directed to a method of modifying a guardrail end terminal. In some embodiments, this method comprises the steps of: removing a preexisting endcap and guardrails from a series of one or more preexisting posts; positioning a combination drill jig and locating guide at the base of the one or more posts; cutting the one or more posts above ground level into two parts using an abrasive wheel or mechanical saw, creating a top part and a bottom part of the posts; drilling one or more through holes through the top part and bottom part of the one or more posts; removing the combination drill jig and locating guide from the base of the one or more posts; attaching a three sided coupling to the top part and bottom part capable of holding the top part and the bottom part of the posts together by fastening with one or more fasteners; attaching the safety guardrail apparatus described above by attaching the front plate, one or more diverters, and one or more support plates to the top part of the first post, and inserting at least one guardrail into the path defined by the diverter.

DETAILED DESCRIPTION

Figure 1:
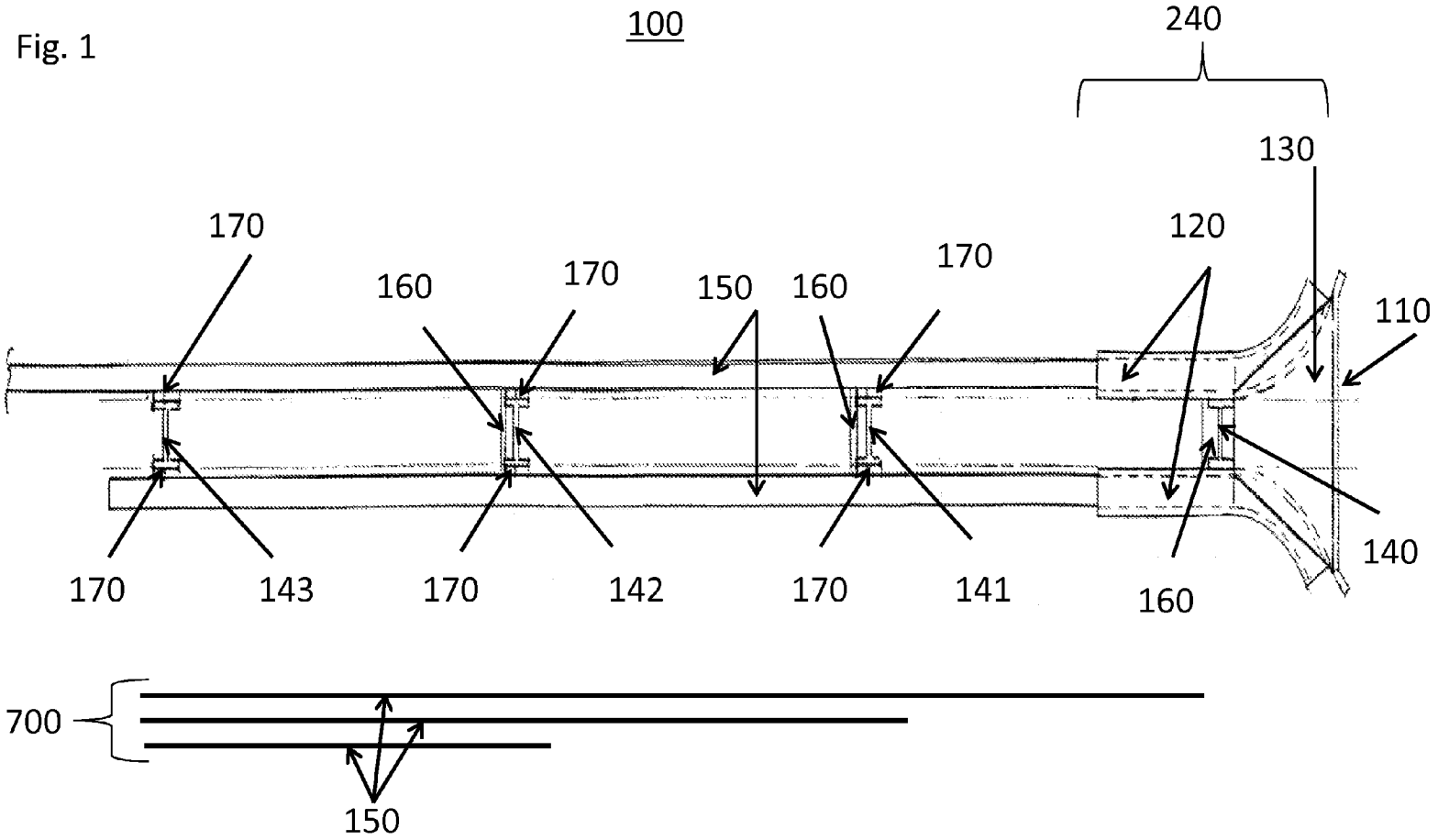
FIG. 1 illustrates a top view of one embodiment of the present invention.

This disclosure describes the best mode or modes of practicing the invention as currently contemplated. This description should not be understood in a limiting sense. Rather, it provides examples of the invention solely for illustrative purposes by reference to the accompanying drawings to advise one of ordinary skill in the art of the advantages and construction of the invention. Many variations or aspects of the invention that are not described will be readily apparent to a person of ordinary skill in the art. Like reference numbers or letters in the drawings designate the same or similar parts.

One embodiment of the invention is directed to a novel guardrail end terminal comprising one or more four-walled non-linear diverters defining a path between an open anterior end and open posterior end attached to one or more support plates and a front plate. The diverters may be adapted to pass one or more tiered guardrail layers through the non-linear path.

The diverters, support plates, and front plate may be positioned to face oncoming traffic along a highway. If a vehicle veers off the road and strikes the end terminal, the guardrails will be forced through the non-linear path of the diverters. As the guardrails are forced through the non-liner diverters, the kinetic energy of the vehicle is transferred to the deformation of the guardrails. Specifically, as the guardrails are forced through the diverters they will be bent, or pealed, into a curved or spiraling shape.

In addition, a novel combination of tiered guardrails may be used according to one embodiment of the invention to increase resistance as the end terminal is forced to slide along the tiered guardrails. More specifically, when two or more guardrails are tiered, more force is required to push the end terminal diverters along the rails. In other words, the opposing force created by increased tiers of guardrails requires increased vehicular energy to deform the guardrails into a curved or spiraling shape. Thus, the force opposing the end terminal sliding along the guardrails will increase along the length of the guardrails. The benefit of this system is that it is capable of safely decelerating vehicles having a wide range of momentums. For example, a car moving at a moderate speed may impact an embodiment of the end terminal and may be completely decelerated by forcing a single guardrail layer through the diverters. Alternatively, a car moving at a high rate of speed, having larger momentum, may be completely decelerated only by forcing two or more tiered guardrails through the diverters.

Another aspect of the present invention is that the diverters are capable of collecting the posts holding up the guardrail, thereby preventing them from impaling a vehicle or being ejected onto a highway. For example, the diverters are connected to a support plate and front plate and are spaced apart from each other at a distance approximately equal to the posts. In this embodiment of the invention, the posts will be designed to break away after receiving an impact of a particular magnitude. Upon a collision, the diverters slide along the guardrails with increasing resistance, and shear off the bolts, or other fastener, holding the guardrails to the posts. As the diverters slide along the rails, each post is detached from the guardrail by shearing the connecting bolt and the post is collected between the diverters until the vehicle reaches a complete stop.

In another aspect of the invention, spacers located between the posts and the guardrails have a through-hole adapted to interface with a through-hole on the guardrails and posts, through which a bolt and nut may hold the guardrails, spacers, and posts together. In one or more embodiments, the spacer comprises sharp edges that are adapted to shear the bolt upon impact by the diverters. Thus, the spacers may facilitate the controlled collection of the posts in between the diverters.

One or more embodiments of the present invention may be made from a carbon steel material, with the whole or parts being cast or fabricated and welded as applicable. Other suitable materials may be employed as well.

FIG. 1 illustrates a top down view of one embodiment of the safety guardrail 100 of the present invention with a front plate 110, diverters 120, support plate 130, posts 140-143, rails 150, couplings 160, and spacers 170. Specifically, the front plate 110 is attached to the support plate 130 and the diverters 120. The support plate 130 may also be attached to the diverters 120 and the first post 140. The front plate 110, the support plate 130, the diverters 120, and the post 140 may be welded together or attached to one another with bolts. The diverters 120 comprise a hollow body defining an interior space. In some embodiments, one or more rails 150 may be inserted into the interior space of the diverters 120. The rails 150 may also be attached to one or more posts 141-143 via one or more spacers 170. In one or more embodiments, the spacers 170 may be placed between the rails 150 and the post 141. In some embodiments, the rails 150, the posts 141, and the spacer 170 may be fastened together with a bolt or screw, or may be welded together. In one or more embodiments, the posts 140-143 may be attached to a coupling 160. The coupling 160 may be attached to the posts 140-143 by being fastened with a bolt.

Figure 2:
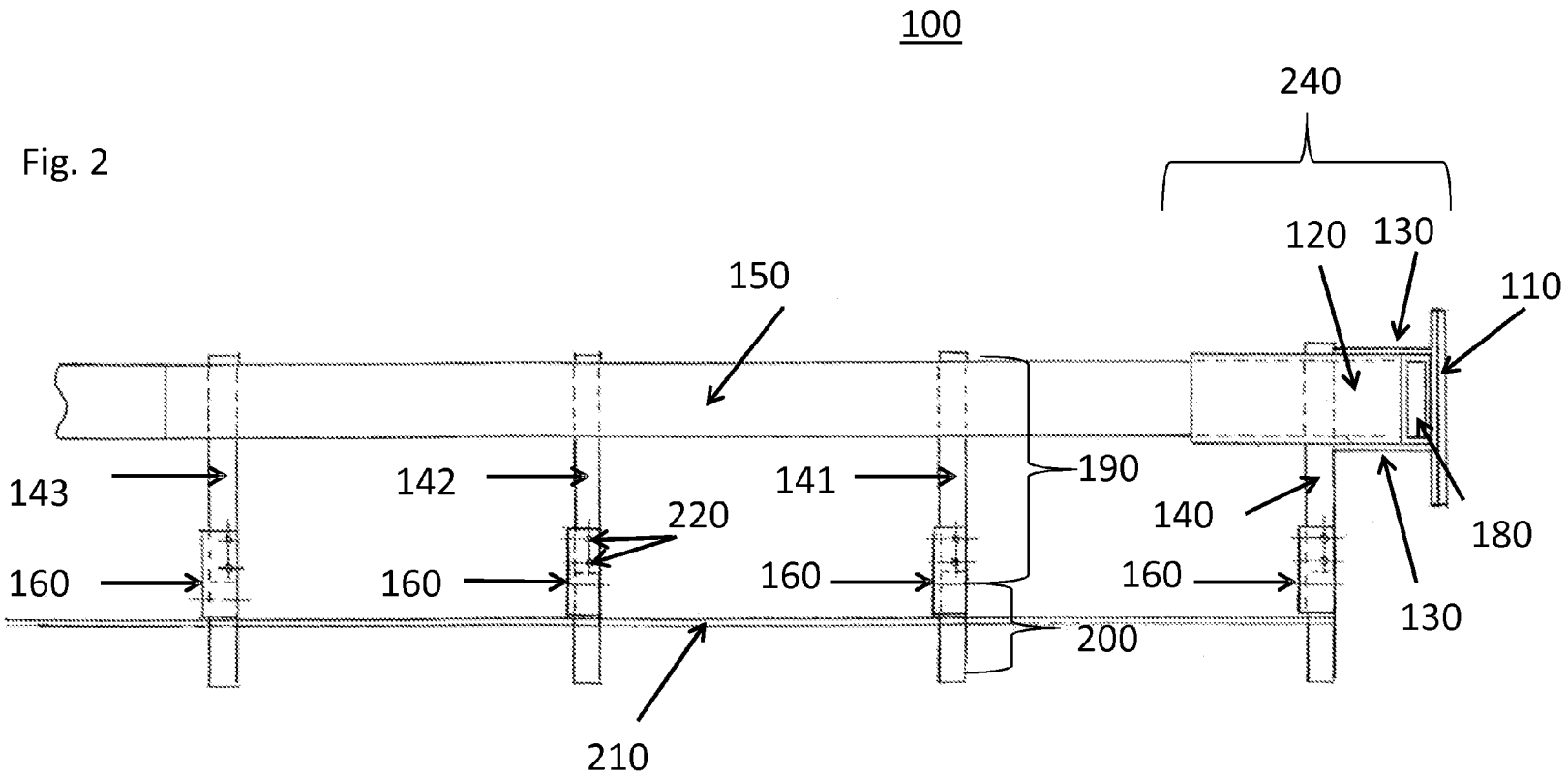
FIG. 2 illustrates a side view of one embodiment of the present invention.

FIG. 2 shows a side view of another embodiment of the safety guardrail 100 of the present invention with a front plate 110, diverter 120, support plates 130, posts 140-143, rails 150, and couplings 160. The side view of the safety guardrail 100 in FIG. 2 also illustrates one of the front diverter openings 180 leading to the interior space defined by the diverter 120.

As seen in FIG. 2, the posts 140-143 may be divided into two parts: a top part 190 and a bottom part 200. The top part 190 and the bottom part 200 of the posts 140-143 may be two separate units that are held together by coupling 160. In other embodiments, the posts 140-143 may have perforations or other modifications that weaken the post along a line to form a top part 190 above and a bottom part 200 below the line in the post. More than half of the bottom part 200 of the posts 140-143 may be located below ground level 210. In other embodiments, all of the bottom part 200 of the posts 140-143 may be below ground level 210. In yet other embodiments, less than half of the bottom part 200 of the posts 140-143 may be located below ground level 210. FIG. 2 also shows that the couplings 160 may be connected to the posts 140-143 by being fastened by one or more side bolts 220.

As seen in FIG. 1, one or more embodiments of the present invention employ multiple guardrail 150 tiers that are forced through the diverter 120 upon a vehicle impacting the end terminal 240. For example, some embodiments employ two or more guardrails arranged in a tier. In some embodiments, between posts 140 and 141 there is one layer of guardrail; between posts 141 and 142, there are two guardrails tiered one above the other; between posts 142 and 143, there are three guardrails tiered one atop the other. An exploded view of the three tiered guardrail according to one embodiment of the present invention is seen as 700.

While the invention illustrated in FIG. 1 represents the guardrails being tiered according to this position between posts, it should be understood that the guardrails may be tiered in any manner irrespective of the position of posts. For example, one or more embodiments of the invention may employ two or more guardrails arranged in a tier with no intervening posts along the length of the guardrails. Alternatively, one or more embodiments may employ two or more guardrails arranged in a tier with greater than four intervening posts along the length of the guardrails.

Figure 3:
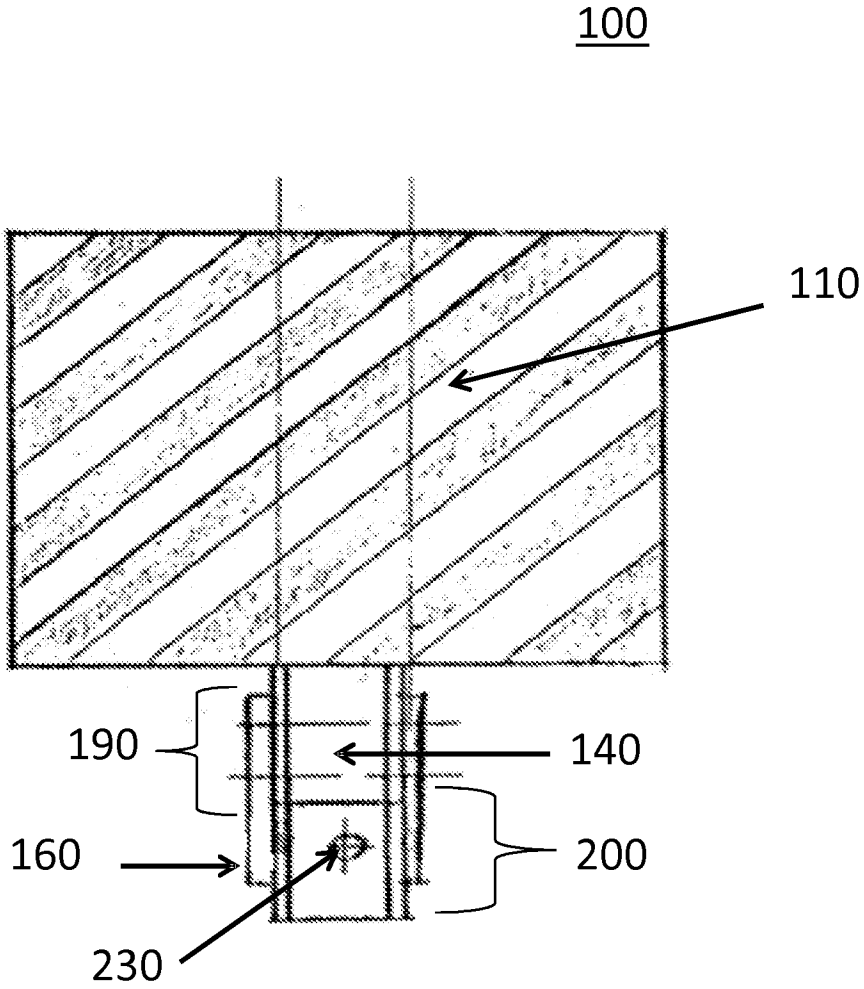
FIG. 3 illustrates a front view of one embodiment of the present invention.

FIG. 3 shows a front view of a safety guardrail 100 showing a front plate 110, a post 140, and coupling 160. FIG. 3 also shows the top part 190 and bottom part 200 of the post 140. In one or more embodiments, a linear bolt 230 passes through the bottom part 200 and the coupling 160, holding the bottom part 200 and coupling 160 together. In one or more embodiments, a linear bolt may pass through the top part or bottom part in a direction perpendicular to the front plate 110, connecting the coupling to the post.

Figure 4:
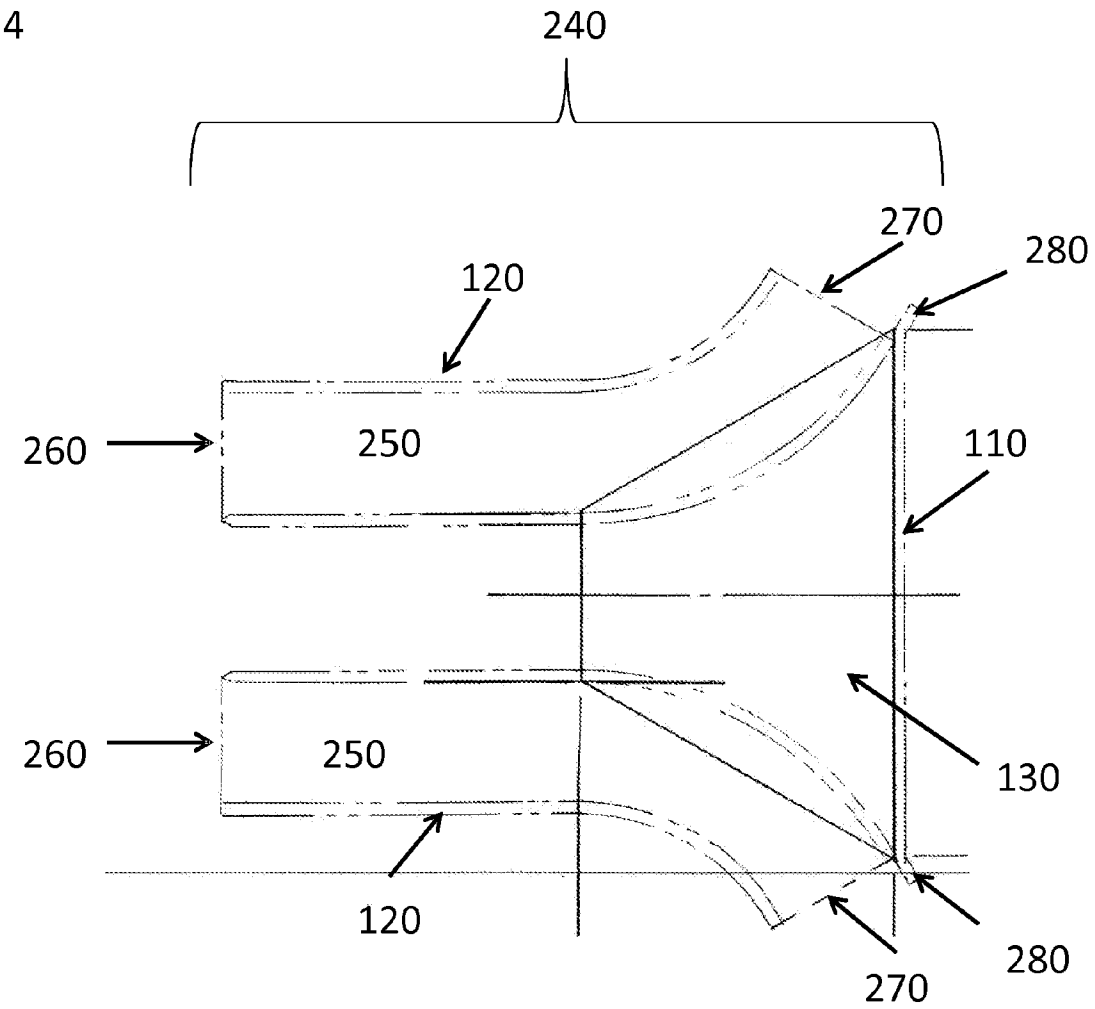
FIG. 4 illustrates a top view of the diverters, front plate, and support plate according to one embodiment of the present invention.

FIG. 4 illustrates an embodiment of the end terminal 240 of the present invention comprising diverters 120, front plate 110, and support plate 130. FIG. 4 also illustrates the diverters 120 comprising a hollow body defining an interior space 250. In some embodiments, the diverters 120 have the shape of a rectangular tube with a flared end. In some embodiments, the rear diverter opening 260 is substantially parallel to the front plate 110, while the front diverter openings 270 are at an oblique angle to the front plate 110. In yet other embodiments, the front diverter openings 270 may be substantially perpendicular to the front plate 110. In some embodiments, two diverters 120 may be attached to the support plate 130 such that the linear portions of the diverters 120 are parallel to each other and are spaced approximately 5 and ⅞ inches apart. As seen in FIG. 4, one or more embodiments of the present invention have a front plate 110 comprising flared edges 280. The front plate may have a thickness in the range of approximately ⅜ inch to ½ inch. In some embodiments, the flared edges 280 flare forward at an oblique angle to the rest of the front plate 110.

Figure 5:
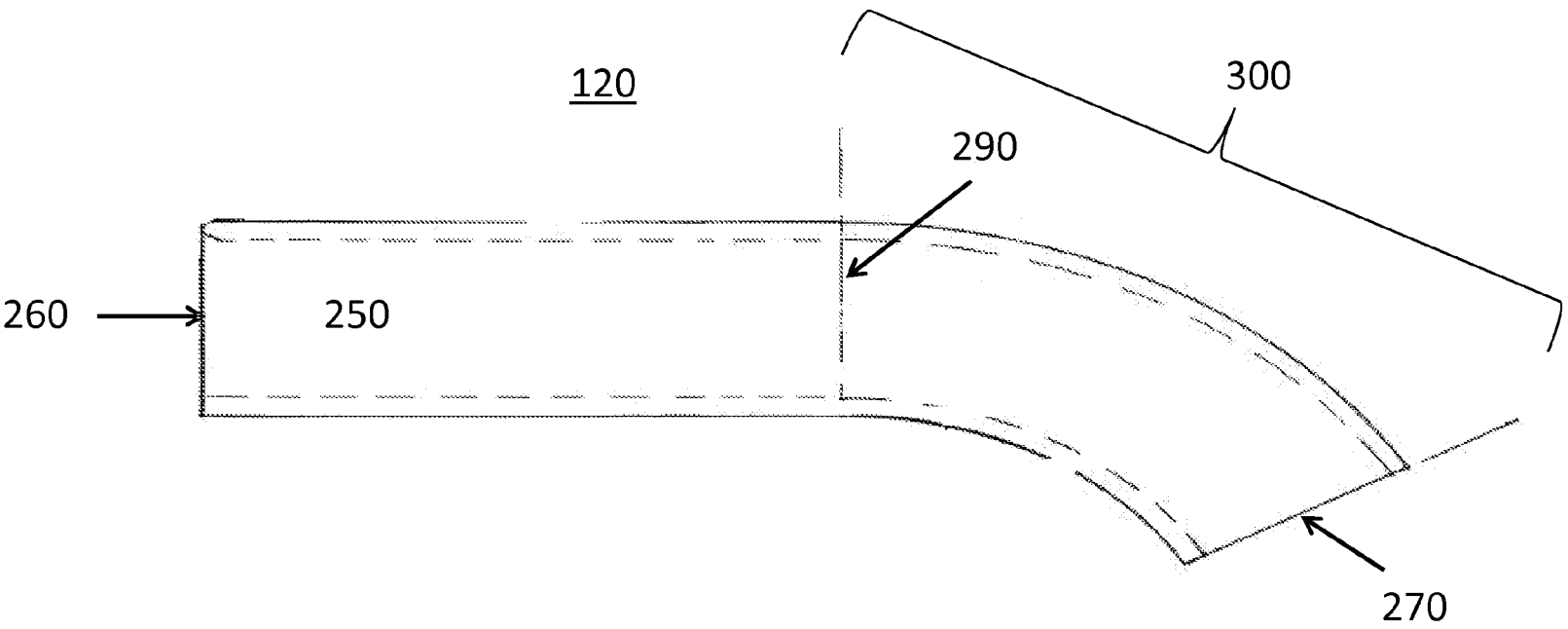
FIG. 5 illustrates a top view of a single diverter according to one embodiment of the present invention.

FIG. 5 further illustrates the flaring of a diverter 120 according to one embodiment of the present invention. In some embodiments, the front end of the diverter 120 may flare with an angle of rotation of approximately 30 degrees, as measured from the front diverter opening 270 to the beginning 290 of the flared region 300. In other embodiments, the front end of the diverter 120 may flare with an angle of rotation of between approximately 30 degrees and 45 degrees. In one or more embodiments, the distance between the rear diverter opening 260 and the beginning 290 of the flared region 300 is approximately 12 inches. In other embodiments, the distance between the rear diverter opening 260 and the beginning 290 of the flared region 300 is in the range of approximately 8 to 12 inches, 4 to 8 inches, or 2 to 4 inches. In one or more embodiments the inner width of the interior space 250 is approximately 3.5 inches. In other embodiments, the inner width of the interior space 250 may be in the range of 2 to 4 inches, 4 to 6 inches, or 6 to 8 inches. In various embodiments, the wall thickness of the diverter may be approximately ⅜ inch. The height of the diverter in one or more embodiments may be approximately 15 inches.

The material used to fabricate the diverter according to one or more embodiments may be ASTM A-500 extrusion metal, or other suitable material.

While the diverter 120 illustrated in FIG. 5 comprises a flared end with a constant angle of rotation, in alternative embodiments the diverter 120 may have a flared end with a varying angle of rotation. In yet other embodiments, the diverter 120 may have a flared end comprising multiple straight regions at oblique angles to one another such that they approximate a curve.

Figure 6:
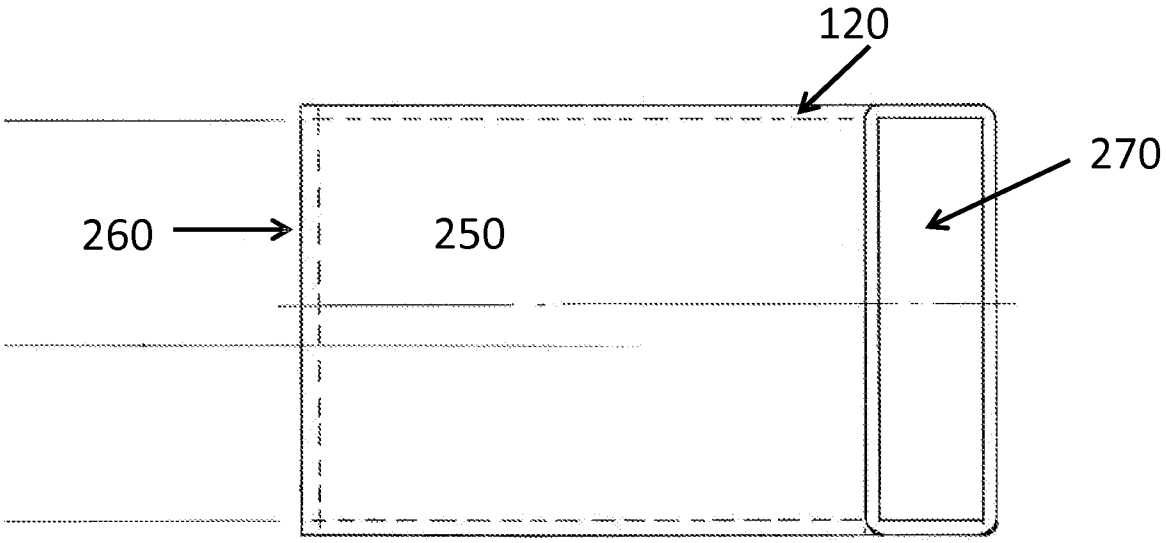
FIG. 6 illustrates a side view of a single diverter according to one embodiment of the present invention.

FIG. 6 illustrates a side view of a diverter 120 according to one embodiment of the present invention. In some embodiments, the inner height of the interior space 250 is approximately 14 inches. In yet other embodiments, the inner height of the interior space 250 is in the range of approximately 10 to 14 inches, 8 to 10 inches, 14 to 18 inches, or 18 to 22 inches.

While the diverter 120 illustrated in FIGS. 5 and 6 has a constant inner height and width, one or more embodiments of the present inventions may continuously or discontinuously change in height or width between the rear diverter opening 260 and the front diverter opening 270.

Figure 7:
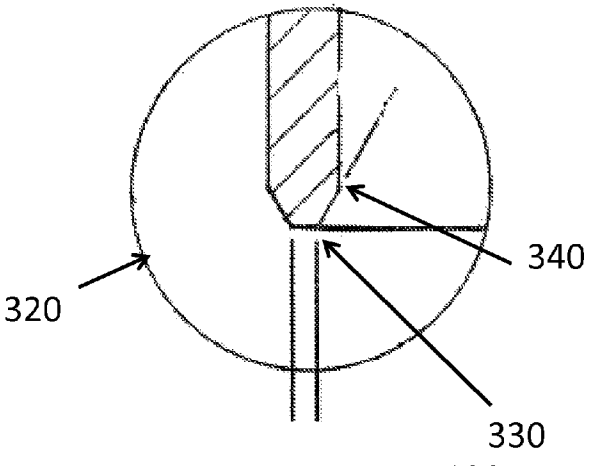
FIG. 7 illustrates a back view of a single diverter according to one embodiment of the present invention.
Figure 7:
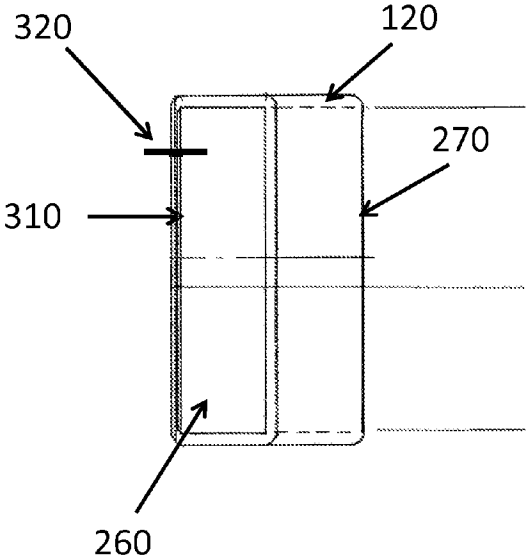

FIG. 7 illustrates a rear view of a diverter 120 according to one embodiment of the present invention. As seen in FIG. 7, the diverter 120 may comprise an inner rear edge 310 that is tapered. In various embodiments, the tapered end of the inner rear edge 310 becomes smaller in a direction toward the rear diverter opening 260. The tapered inner rear edge 310 may have a frustum shaped cross section (see 320), with a width at its narrowest point of approximately ¼ the width at its widest point. In one or more embodiments, the narrowest part of the inner rear edge 310 (the frustal tip 330) may be approximately 3/32 of an inch wide, while the widest part (the frustal base 340) is ⅜ of an inch. In one or more embodiments, the frustal tip 330 may taper from the frustal base 340 having an angle of approximately 30 degrees.

In an alternative embodiment of the present invention, the tapered inner rear edge 310 may taper only on one side. For example, in some embodiments the inner rear edge 310 may taper from the inner wall of the diverter 120 while the outer wall does not taper. The cross section of such tapering may form a right triangle from the start of tapering 350 to the end of the inner rear edge 310, or alternatively a frustum right triangle with tip missing.

Figure 8:
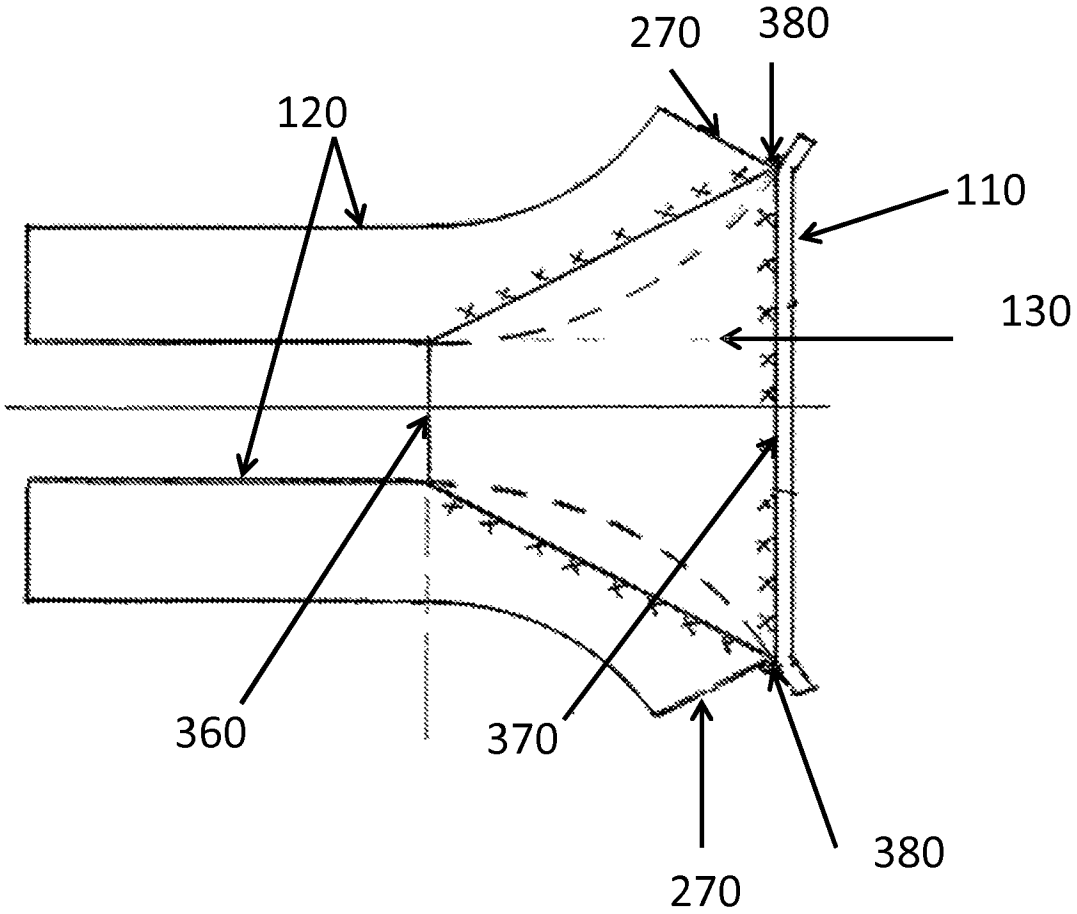
FIG. 8 illustrates a top view of the diverter, front plate, and support plate according to one embodiment of the present invention.

FIG. 8 illustrates a top view of one embodiment of the end terminal of the present invention. FIG. 8 further illustrates how the diverters 120, the front plate 110, and the support plate 130 may be dimensioned and attached to one another. In one or more embodiments, the support plate 130 has a trapezoid shape that has a short edge 360 that is approximately 5 and ⅛ inch long. In some embodiments, the trapezoid shaped support plate 130 may have a length from short edge 360 to long edge 370 of approximately 11 inches. The support plate 130 may be attached to two symmetrically placed diverters 120 such that the support plate 130 covers less than approximately 20% of the surface area of the outer surface of each diverter 120. In other embodiments, one or more support plates 130 may be attached to diverters 120 such that the support plate 130 covers more than 20% of the surface area of the outer surface of each diverter 120.

Figure 9:
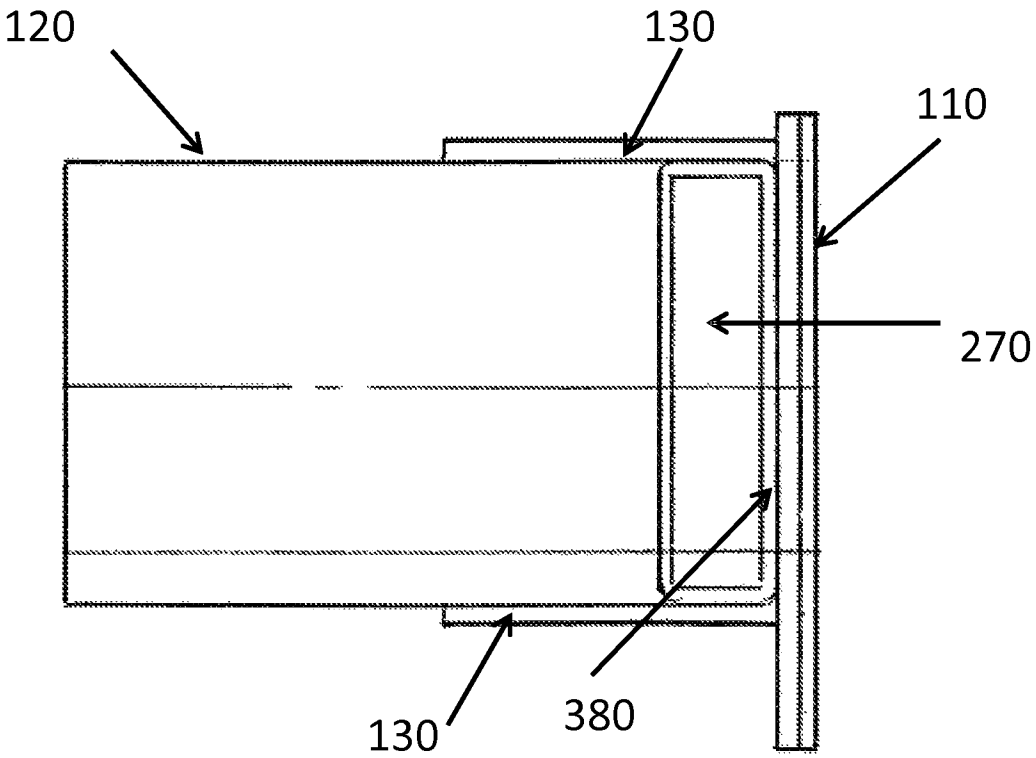
FIG. 9 illustrates a side view of the diverter, front plate, and support plates according to one embodiment of the present invention.

As seen in FIG. 9, the support plate 130 may be attached to both the top of the symmetrically placed diverters 120 and the bottom of the symmetrically placed diverters 120 (only one diverter 120 is visible in the side view of FIG. 9). The front plate 110 may be connected to the support plate located on the top of the diverters 120 and the support plate located on the bottom of the diverters 120. The support plate 130 may be fused to the top and/or bottom of the diverters 120 by being cast or fabricated. In some embodiments, the support plate 130 may be welded to the diverters 120 and the front plate 110 by a ⅜ inch fillet weld with a galvanize finish. In other embodiments, the support plate 130 the diverters 120 and the front plate 110 may be made and attached to one another from a cast.

As seen in FIG. 8, the front plate 110 may be connected to both the long edge 370 of the trapezoid shaped support plate 130 and the inner front edge 380 of the diverter 120. The connection between the support plate 130, the long edge 370, and the inner front edge 380 may be fused by one or more welding joints. In various embodiments, the dimensions, shape, and position of the front plate 110 is such that the front plate does not obstruct the front diverter opening 270.

Figure 10:
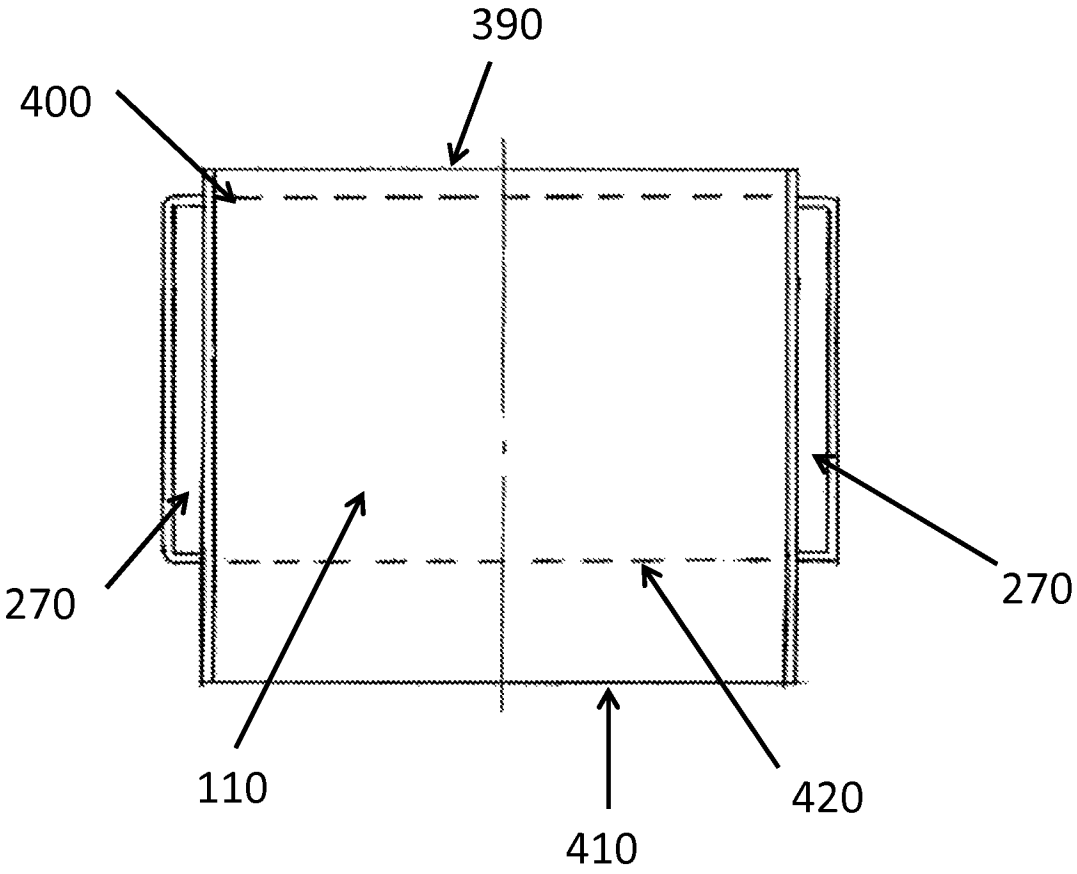
FIG. 10 illustrates a front view of the diverters and front plate according to one embodiment of the present invention.

As seen in FIGS. 9 and 10, the front plate 110 may have a height of approximately 16 inches and may be affixed to the diverters 120 and support plates 130 such that the top edge 390 of the front plate 110 is approximately 1 and ¼ inch from the top edge 400 of the diverter 120. As seen in FIGS. 9 and 10, in alternative embodiments the front plate 110 may have a height and position such that there is a greater distance between the bottom edge 410 of the front plate 110 and the bottom edge 420 of the diverter 120 when compared to the distance between the top edge 390 of the front plate 110 and the top edge 400 of the diverter 120. In yet other embodiments, the distance between the bottom edge 410 of the front plate 110 and the bottom edge 420 of the diverter 120 is approximately the same as the distance between the top edge 390 of the front plate 110 and the top edge 400 of the diverter 120.

Figure 11:
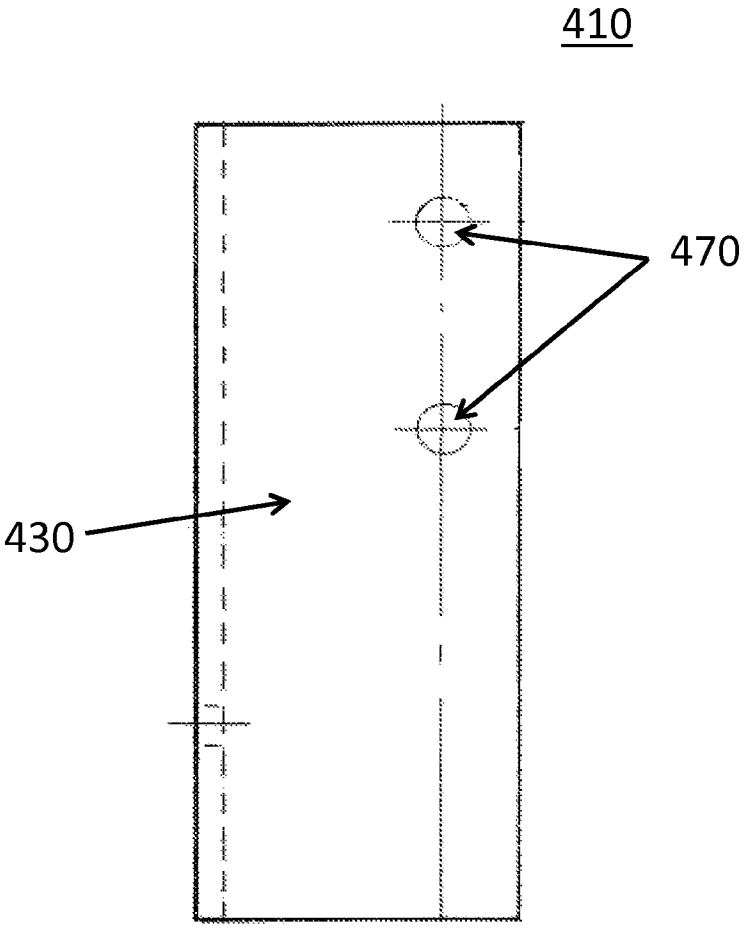
FIG. 11 illustrates a side view of a coupling according to one embodiment of the present invention.
Figure 12:
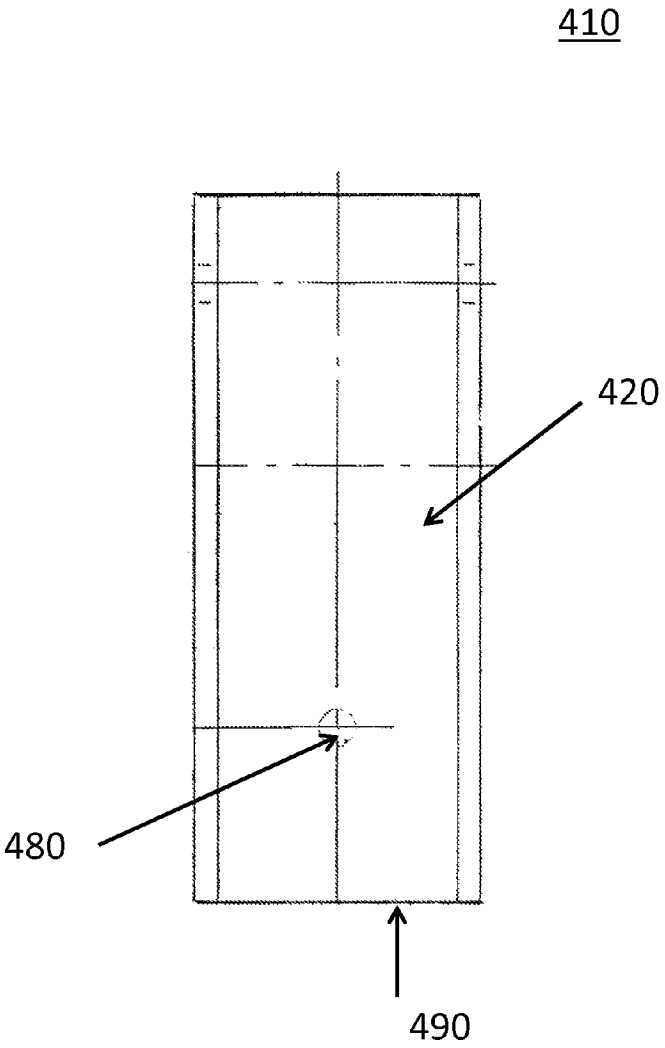
FIG. 12 illustrates a front view of a coupling according to one embodiment of the present invention.
Figure 13:
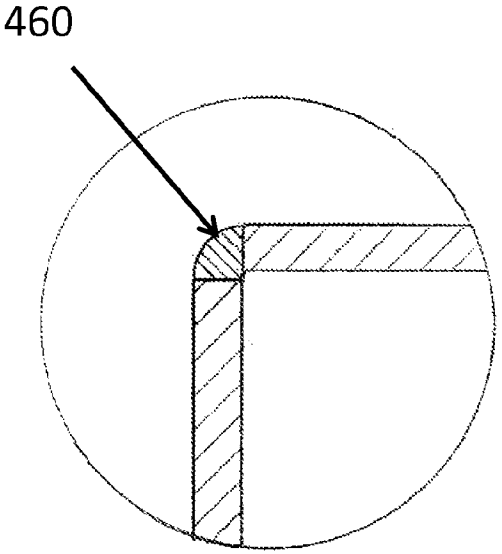
FIG. 13 illustrates a top view of a coupling according to one embodiment of the present invention.
Figure 13:
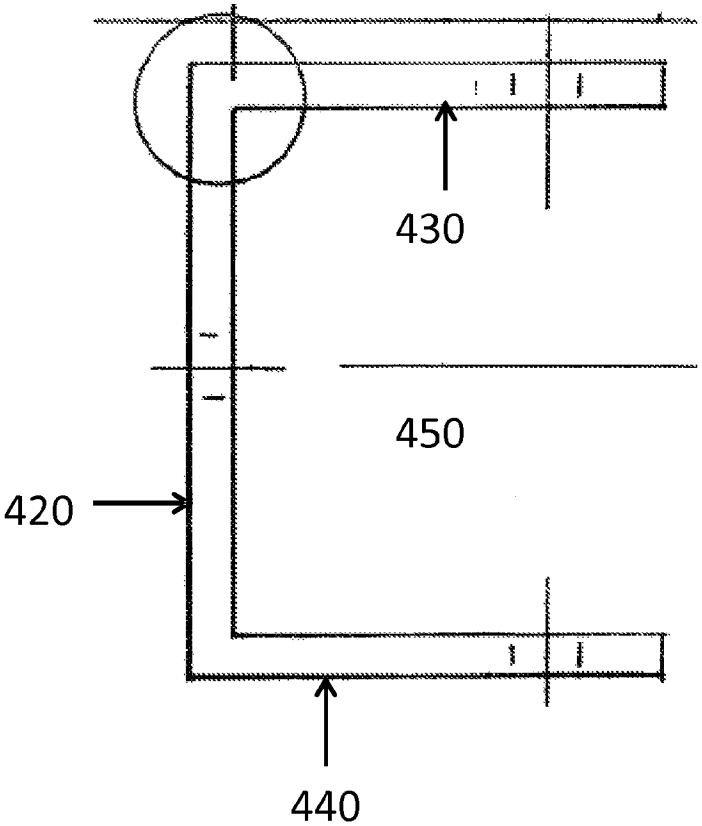

Various embodiments of the present invention also include a coupling 410. As seen in FIGS. 11 and 12, the height of the coupling 410 may be approximately 12 inches. In yet other embodiments, the height of the coupling 410 may be in the range of 4 to 6 inches, 6 to 8 inches, or 8 to 12 inches. In yet other embodiments, the coupling may have a height greater than 12 inches. As seen in FIG. 13, the coupling may comprise three flat surfaces 420, 430, 440, connected in a concave manner to form an interior space 450. In various embodiments, flat surfaces 430 and 440 may be perpendicularly connected to flat surface 420, forming a interior space 450 that is approximately 5 and ⅛ inch across. In one or more embodiments, the joints 460 connecting flat surfaces 430 and 440 to flat surface 420 are rounded. In various embodiments of the present invention, the dimensions and positioning of the flat surfaces 420, 430, 440 may be adapted to form an interior space that approximately matches the dimensions of a post.

The coupling 410 may have various through holes that are adapted to receive a bolt and nut. For example, as seen in FIG. 11, two side through holes 470 of approximately 11/16 inch diameter are approximately three inches apart in either flat surface 430 or 440 (FIG. 11 shows flat surface 430 for illustrative purposes). In various embodiments, the through holes may be spaced greater than or less than 3 inches apart. In alternative embodiments, either flat surface 430 or 440 may comprise a single through hole, or greater than two through holes. The coupling 410 may also comprise one or more through holes in the flat surface 420. For example, as seen in FIG. 12, one or more through holes may be positioned in the middle of the flat surface 420 approximately 3 inches above the bottom edge 490 of flat surface 420.

The position of the through holes in any of flat surfaces 420, 430 or 440 may be adapted to interface with the top part 190 or bottom part 200 of a post 140-143. For example, in one possible embodiment, the through holes 470 located in the flat surfaces 430 and 440 are positioned to interface with through holes located in the top part 190 of the posts 140-143. Accordingly, the interfacing through holes in the top part 190 of posts 140-143 and the through holes in either flat surface 420 and 430 may be adapted to receive a bolt or screw. In one or more embodiments, the bolt or screw may affix the top part 190 of posts 140-143 with the coupling 410. Similarly, the through holes 480 located in the flat surface 420 may be positioned to interface with through holes located in the bottom part 200 of the posts 140-143. Accordingly, the interfacing through holes in the bottom part 200 of posts 140-143 and the through holes in the flat surface 420 may be adapted to receive a bolt or screw. In one or more embodiments, the bolt or screw may affix the bottom part 200 of posts 140-143 with the coupling 410.

Figure 20:
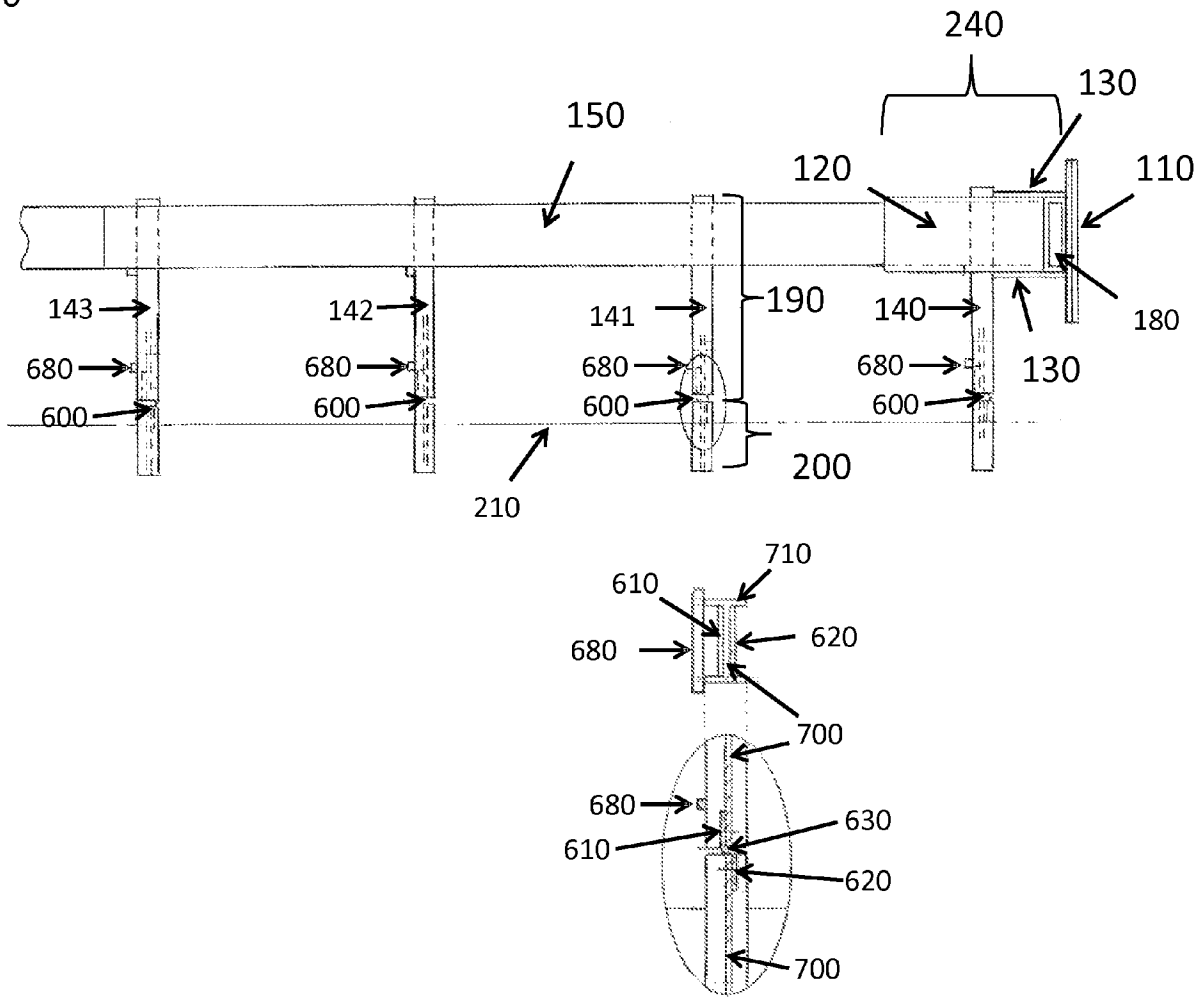
FIG. 20 illustrates a side view of one embodiment of the present invention.

Another embodiment of the present invention may employ a z-coupling 600 seen in FIG. 20. In various embodiments, the z-coupling 600 has an upper part 610 and a lower part 620. The upper part 620 of the z-coupling 600 may be oriented substantially parallel to the lower part 620 of the z-coupling 600, with the upper part and lower part being connected by a perpendicular part 630. As seen in FIG. 20, the upper part 610 of the z-coupling 600 may be connected to the posterior side of the top part 190 of the posts 140-143, and the lower part 620 may be connected to the anterior side of the bottom part 200 of the posts 140-143. This connection may be made to the web 700 of an I-beam shaped post. After a collision, as the top part of the posts are collected between the diverters, the top part of a preceding post may pass over the bottom part of a subsequent post in the series. This is possible because, upon impact, the z-coupling 600 may detach from both the top part 190 and bottom part 200 of the subsequent post, and rotate around the perpendicular part 630, guiding the top part of the preceding post over the bottom part of the subsequent post. The dislocation of the z-coupling from the posts may be facilitated by an impact from a bumper 680 which may be attached to the top part 190 of the posts 140-143. This bumper 680 may be a long rectangular shape attached to the flanges 710 of the I-beam shaped posts.

Figure 21:
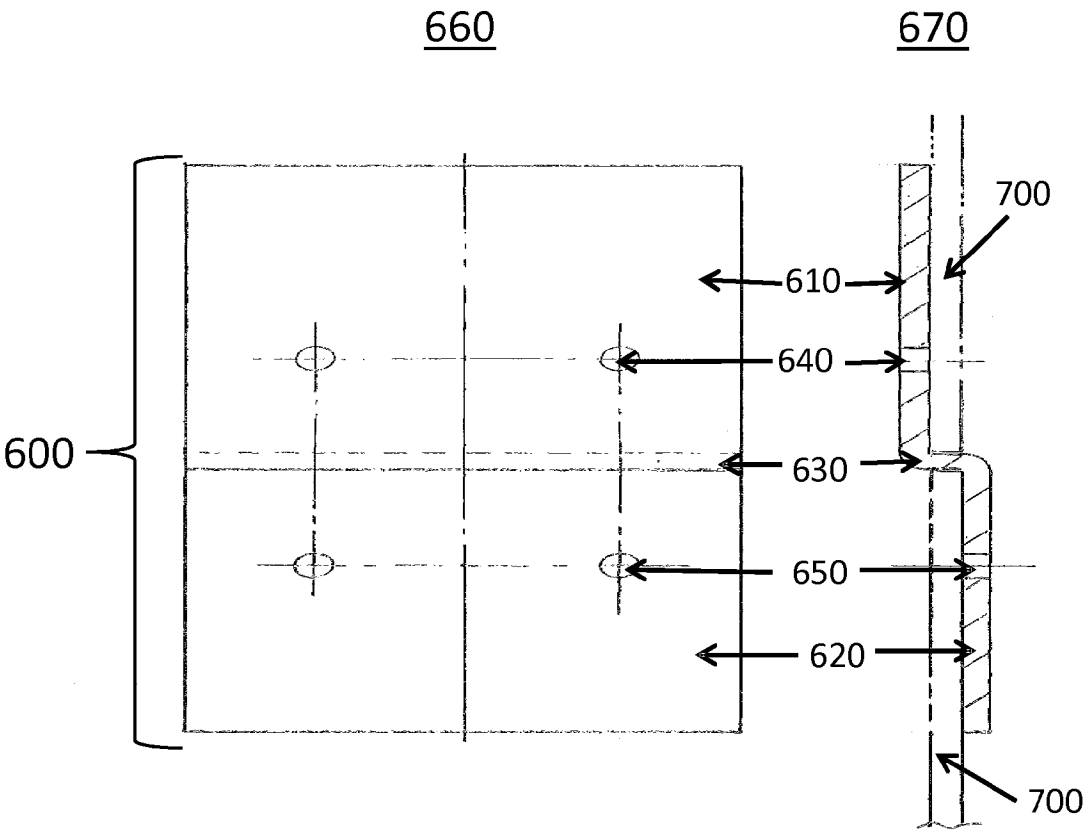
FIG. 21 illustrates a front view and cross sectional side view of one embodiment of the present invention.

FIG. 21 shows another embodiment of the z-coupling from a front view 660 and a cross sectional side view 670 positioned on the web 700 of a post. The upper part 610 of the z-coupling may have one or more through holes 640 that are adapted to receive a bolt and nut. Similarly, the lower part 620 of the z-coupling may have one or more through holes 650 that are adapted to receive a bolt and nut. The bolts and nuts that are received by through holes 640 and 650 may have the same strength or different strengths. The upper part 610 may be connected to the posterior side of the web 700 of an I-beam shaped post, and the lower part 620 may be connected to the anterior side of the web 700 of an I-beam shaped post. While the various embodiments of the z-coupling represented in FIGS. 20 and 21 show an upper part 610 and lower part 620 connected by a perpendicular part 630, other embodiments may include additional structures that provide additional strength to the z-coupling. For example, in one or more embodiments, the z-coupling may comprise additional structures that are connected to and run perpendicular to each of the upper part 610, the perpendicular part 630, and the lower part 620. These structures may provide additional strength to the z-coupling and post.

Figure 14:
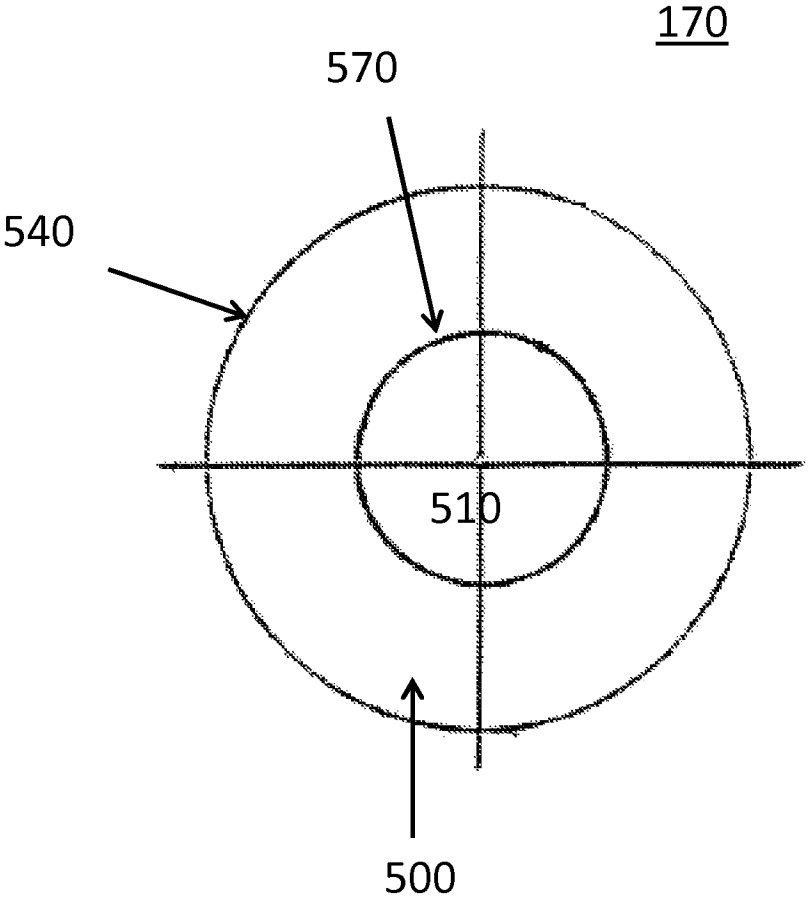
FIG. 14 illustrates a side view of a spacer according to one embodiment of the present invention.
Figure 15:
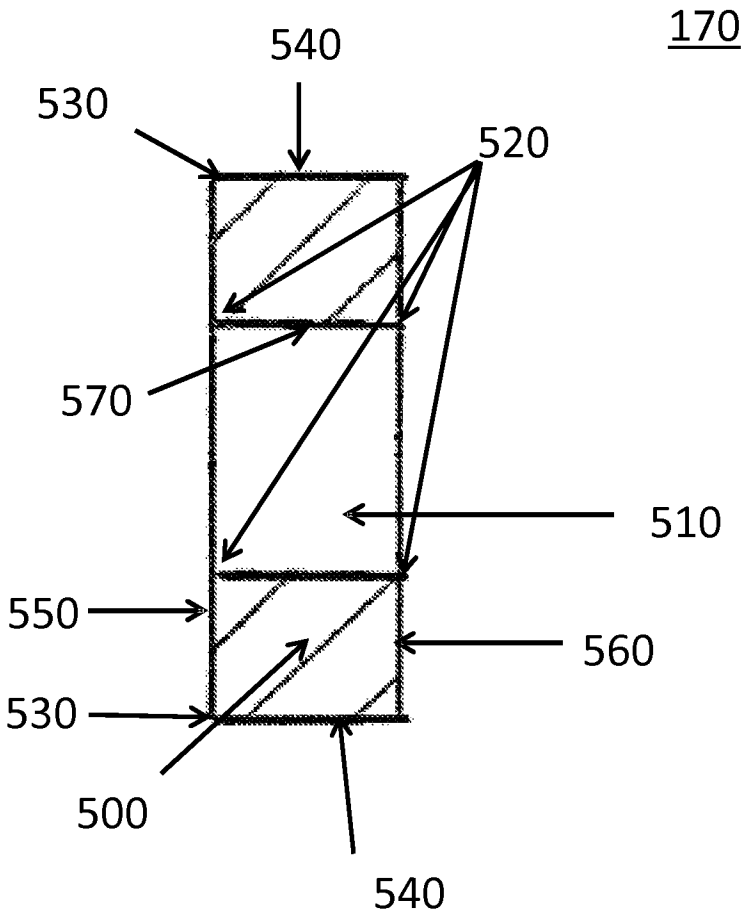
FIG. 15 illustrates a cross sectional front view of a spacer according to one embodiment of the present invention.

In one or more embodiments of the present invention, the guardrails 150 may be connected to posts 141-143 via spacers 170. As seen in FIGS. 14 and 15, in some embodiments, the spacer 170 may comprise a cylinder 500 defining an interior space 510. In some embodiments, the outer diameter of the cylinder 500 is approximately 1 and ¼ inch, the inner diameter of the cylinder 500 is ¾ inch, and the height of the cylinder is ½ inch. In various embodiments, the inner edges 520 and outer edges 530 are sharp. The outer surface 540 may be between a 45 to 90 degree angle relative to the top surface 550 and bottom surface 560 of the spacer 170. Similarly, the inner surface 570 may be between a 45 to 90 degree angle relative to the top surface 550 and bottom surface 560. In various embodiments, the interior space 510 is adapted to interface with a through hole located in the guardrail 150 and a through hole in the posts 141-143. The interfacing through holes between the guardrail 150, spacer 170 and posts 141-143 may be adapted to receive a bolt or screw capable of fastening the spacer 170 between the guardrail 150 and posts 141-143. The material used to manufacture the spacer 170 may be hot or cold rolled mechanical tubing with a galvanized finish.

Figure 16:
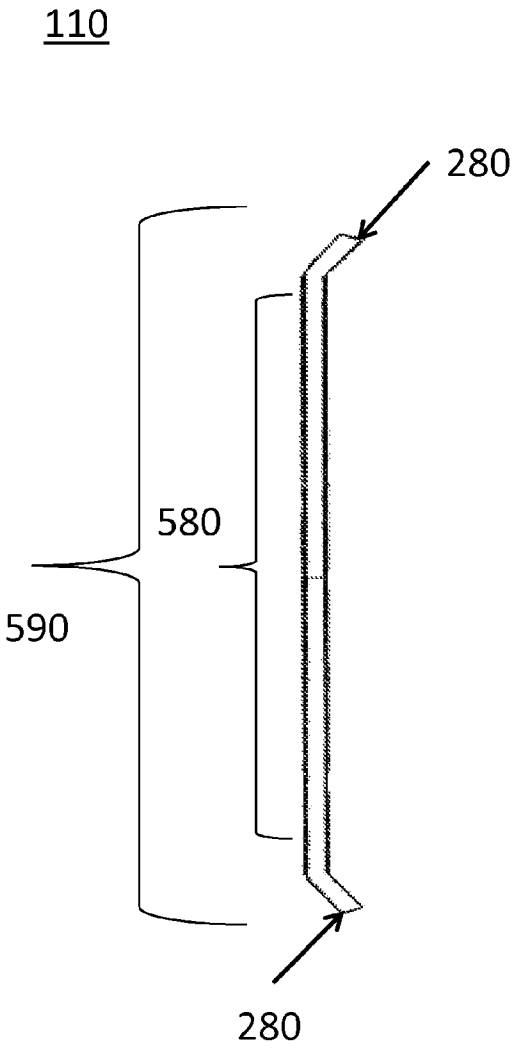
FIG. 16 illustrates a top view of the front plate according to one embodiment of the present invention.
Figure 17:
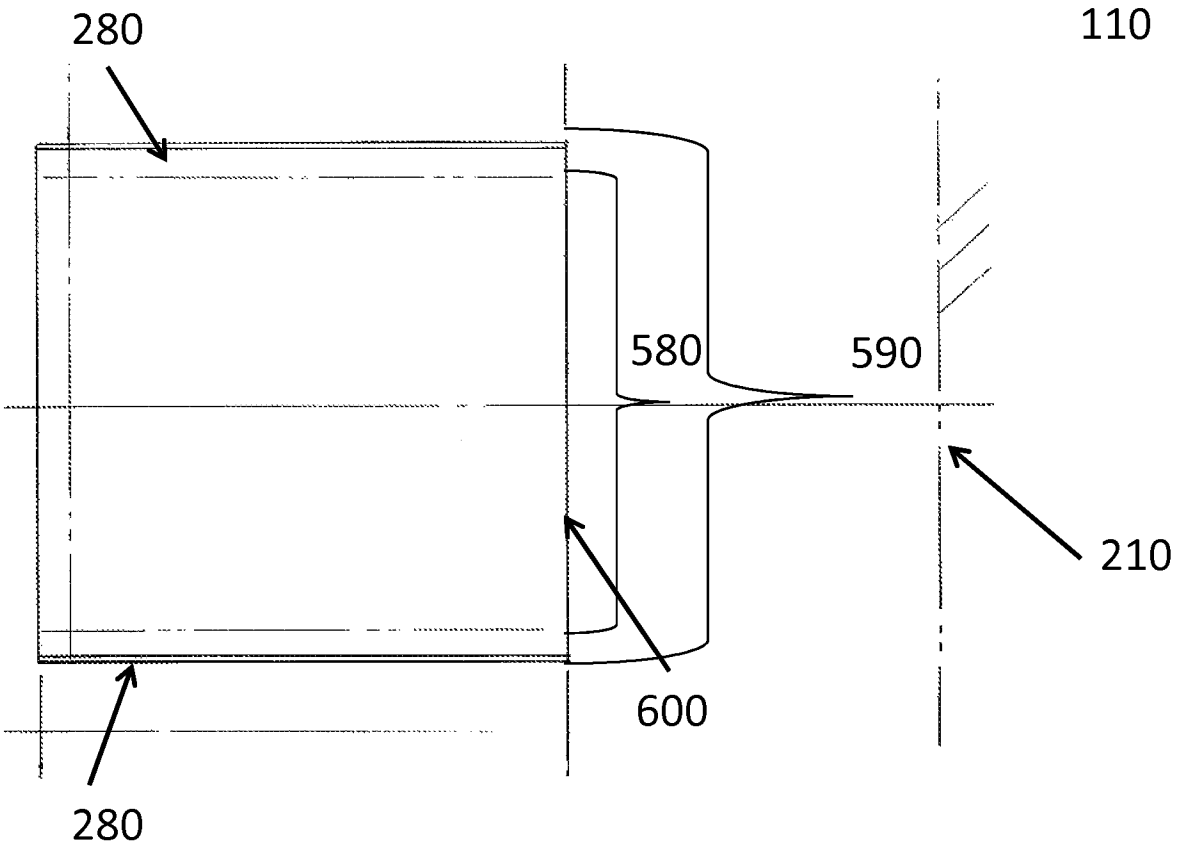
FIG. 17 illustrates a front view of the front plate according to one embodiment of the present invention.

As seen in FIGS. 16 and 17, one or more embodiments of the invention comprise a front plate 110 having one or more flared edges 280. The flared edges 280 may flare at an angle of 30 degrees relative to the main body 580 of the front plate 110. In other embodiments, the flared edges 280 may flare at an angle in the range of approximately 30 to 45 degrees, 45 to 55 degrees, 55 to 65 degrees, 65 to 75 degrees, or greater than 75 degrees. The front plate 110 may have an overall width 590 of approximately 20 inches, with the main body 580 of the front plate 110 having a width of approximately 16 inches. In some embodiments of the invention, the front plate 110 is positioned such that the bottom edge 600 of the front plate 110 is approximately 12 inches above ground level 210.

Figure 18:
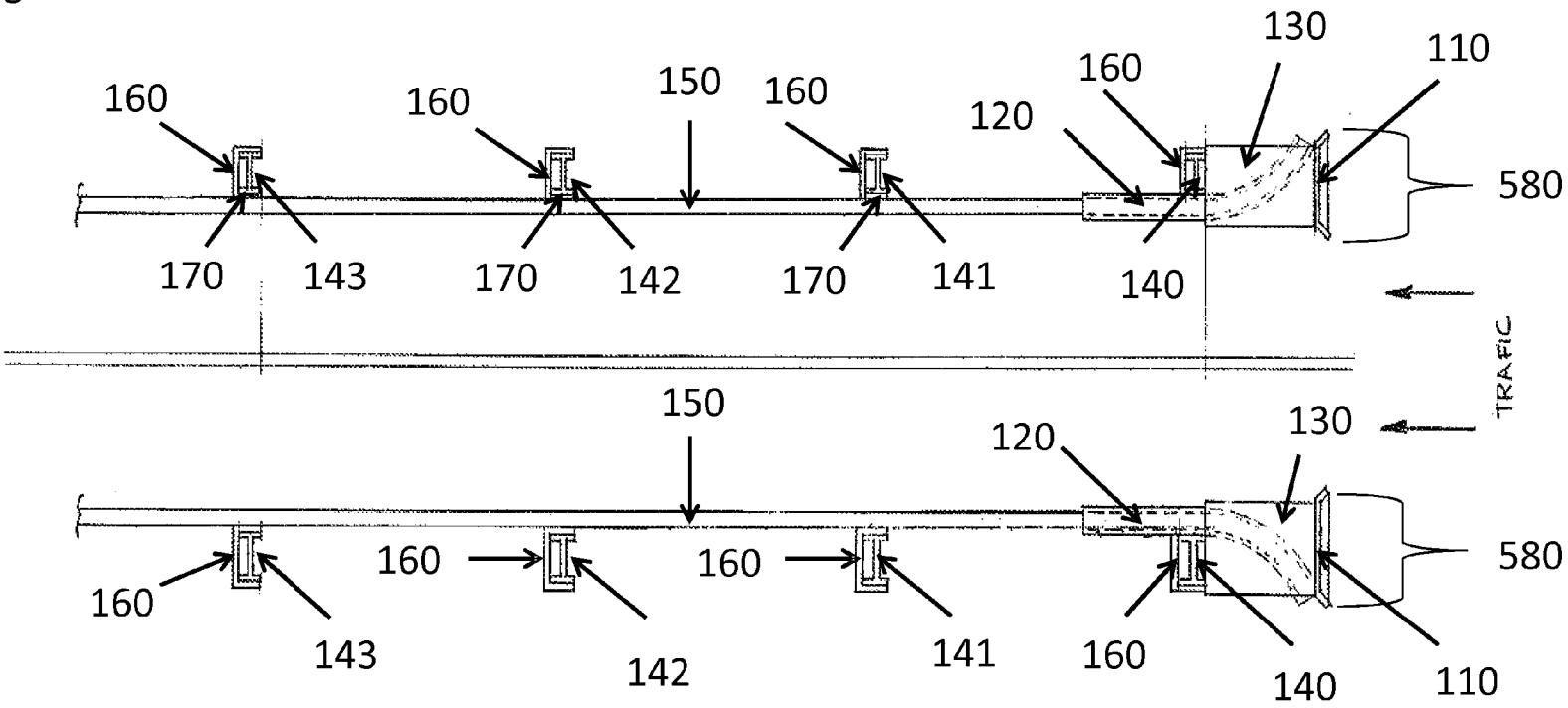
FIG. 18 illustrates a top view of one embodiment of the present invention.
Figure 19:
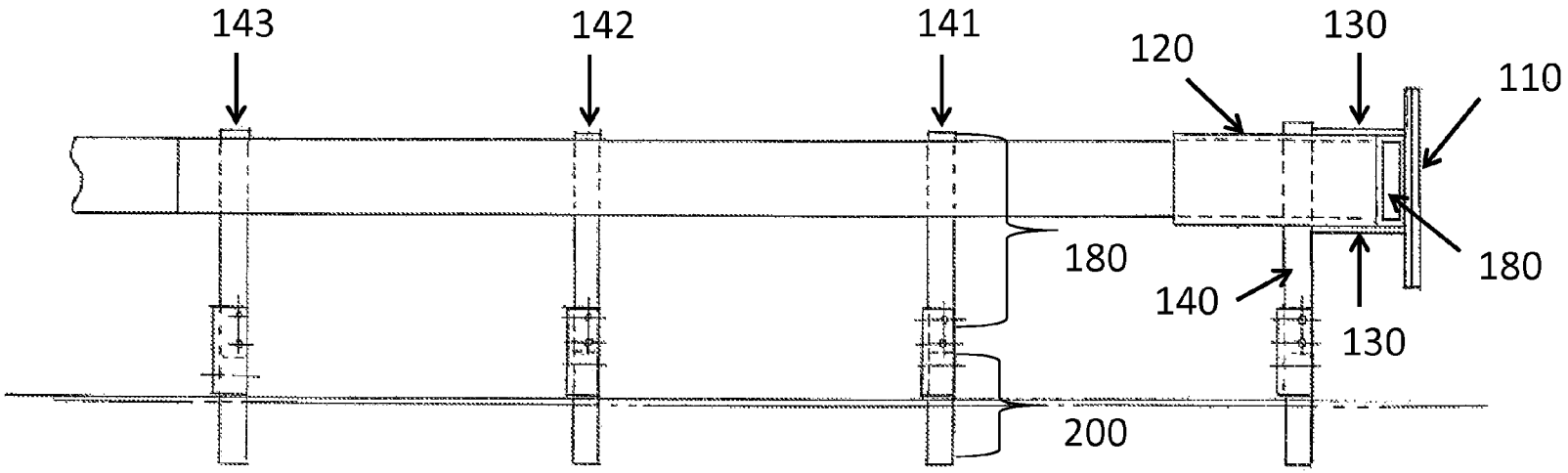
FIG. 19 illustrates a side view of one embodiment of the present invention.

While various embodiments of the present invention are directed to utilizing one or more guardrails placed on each side of the posts 140-143, alternative embodiments may utilize guardrails placed on a single side of posts 140-143. FIGS. 18 and 19 illustrate exemplary and non-limiting embodiments of the invention with guardrails 150 placed on only one side of the posts 140-143. In one embodiment, the main body 580 of front plate 110 is attached to a rectangular shaped support plate 130. The rectangular support plate may be affixed to the top of diverter 120 and the first post 140. In this configuration, some embodiments of the diverter 120 may flare in a direction towards and across the line of posts 140-143 rather than away from the line of the posts (see for comparison FIG. 1).

Referring generally to FIGS. 1-21, when an automobile impacts the end terminal 240, the kinetic energy of the moving vehicle may be sufficient to shear off the linear bolt in the coupling on the first post. This will free the end terminal 240 from the first post, allowing the forward motion of the vehicle to push the end terminal to slide on the guardrails. In one or more embodiments, the end terminal will be forced to slide and divert one or more pairs of guardrails. Thus, the kinetic energy of the moving vehicle will be transferred to the shearing of the liner bolt and bending of the one pair of guardrails through the diverters 120. This will slow down the vehicle.

If the kinetic energy of the moving vehicle is sufficient, it may push the end terminal until it reaches the second post. When the diverters 120 of the end terminal 240 reach the second post, the diverters will shear off the bolts, or other fastener, in the top section of the second post and shear off the linear bolt in the coupling. This will allow the end terminal 240 to continue sliding along the guardrails. After passing the second post, however, two pairs of guardrails will be forced through the diverters 120. Because of the additional opposing force resulting from pushing two pairs of guardrails through the diverters 120, the vehicle will be slowed at a greater rate.

If the kinetic energy of the moving vehicle is sufficient, it may continue to push the end terminal 240 until it reaches the third post. When the diverters 120 of the end terminal 240 reach the third post, the diverter will shear off the bolts, or other fastener, in the top section of the third post and shear off the linear bolt in the coupling. This will allow the end terminal 240 to continue sliding along the guardrails. After passing the third post, however, three pairs of guardrail will be forced through the diverters 120. Because of the additional opposing force resulting from pushing three pairs of guardrail through the diverters 120, the vehicle will be slowed at yet a greater rate.

Referring generally to FIGS. 18 and 19, a similar mechanism for controlled deceleration is utilized for embodiments of the invention that employ one or more guardrails on only one side of the posts. When an automobile impacts the end terminal 240, the kinetic energy of the moving vehicle may be sufficient to shear off the linear bolt in the coupling on the first post. This will free the end terminal 240 from the first post, allowing the forward motion of the vehicle to push the end terminal to slide along on the guardrails located on one side of the posts. In one or more embodiments, the end terminal will be forced to slide and divert one or more guardrails. Thus, the kinetic energy of the moving vehicle will be transferred to the shearing of the liner bolt and bending of the guardrail(s) through the diverters 120. This will slow down the vehicle. As described above, additional opposing force will result as the end terminal is forced to slide along the rail(s) through additional posts. As each post subsequently breaks away upon impact the shape of the diverter will kick the free post in a direction away from the highway.

In sum, when forced through the diverters 120, the guardrails will act like giant shock-absorbers slowing the vehicle, while the posts simultaneously collapse in a controlled linear manner until the vehicle stops.

One of the main benefits of the invention is that it can be implemented using a substantial number of parts that are currently in existing guardrail end terminals. Specifically, the invention may employ a series of existing vertical posts that are anchored in the ground, and guardrails having standard sizes and designs. Thus, a method of implementing the novel end terminal apparatus using existing infrastructure is provided. First, the existing endcap and guardrails are removed from the existing posts. A combination drill jig and locating guide may be attached at the base of the posts. Using an abrasive wheel or mechanical saw, the posts may be cut at the desired location, forming a top half of the post and bottom half of the post. Through holes may then be drilled into the top half and bottom half at the desired locations. After removing the drill jig and guide, a coupling may be fastened to the top part and bottom part of the post using one or more bolts inserted through the through-holes. The end terminal of the present invention may then be attached to the top half of the first post in the series and welded in place. The guardrail(s) may be attached to the top part of the posts with a spacer and inserted into the diverter.

While the invention has heretofore been described with certain degrees of particularity, there are countless configurations for the apparatus and method of the present invention. FIG. 1 through FIG. 21 illustrate only a few possible configurations, and in no way should be construed as limiting the application of the inventive apparatus to those configurations. To the contrary, the invention is intended to cover various modifications and equivalent arrangements included within the spirit and scope of the appended claims. Furthermore, various steps of the method may be performed in different order to achieve the same result. The method as described should not be construed as limiting the steps to the particular order described. Rather, the method is intended to cover various equivalent arrangements within the spirit and scope of the invention. The scope of the following claims is to be accorded the broadest interpretation so as to encompass all such modifications and equivalent structures and functions.

What is claimed is:

1. A safety guardrail comprising:

a front plate having an anterior surface and posterior surface;

one or more support plates connected to the posterior surface of the front plate;

one or more four-walled non-linear diverters defining a path between an open anterior end and open posterior end, the one or more diverters connected to the one or more support plates;

one or more guardrails having an anterior end and a posterior end, the anterior end of one or more guardrails located inside the path of the diverter;

one or more posts distributed in a first plane, the first post in the plane having a top part connected to the one or more diverters and the one or more support plates;

wherein the anterior end of the one or more diverters flare in a direction away from the first plane;

one or more tube shaped spacers positioned between the one or more post and the one or more guardrails, wherein the one or more tube shaped spacers have sharp edges adapted to shear a fastener.

2. A safety guardrail comprising:

a front plate having an anterior surface and posterior surface;

one or more support plates connected to the posterior surface of the front plate;

one or more four-walled non-linear diverters defining a path between an open anterior end and open posterior end, the one or more diverters connected to the one or more support plates;

one or more guardrails having an anterior end and a posterior end, the anterior end of one or more guardrails located inside the path of the diverter;

one or more posts distributed in a first plane, the first post in the plane having a top part connected to the one or more diverters and the one or more support plates;

wherein the anterior end of the one or more diverters flare in a direction away from the first plane;

wherein at least one diverter and one series of tiered guardrails is connected to the first, second, third, and fourth posts on each side of the first plane, each of the diverters flaring in a direction opposite to each other.

3. A safety guardrail comprising:

a front plate having an anterior surface and posterior surface;

one or more support plates connected to the posterior surface of the front plate;

one or more four-walled non-linear diverters defining a path between an open anterior end and open posterior end, the one or more diverters connected to the one or more support plates;

one or more guardrails having an anterior end and a posterior end, the anterior end of one or more guardrails located inside the path of the diverter;

one or more posts distributed in a first plane, the first post in the plane having a top part connected to the one or more diverters and the one or more support plates;

wherein the anterior end of the one or more diverters flare in a direction away from the first plane;

wherein the diverters have a structural strength capable of withstanding deformation while at least three layers of guardrail are forced through the path between the open anterior end and the open posterior end.

4. A method of modifying a guardrail end terminal comprising the steps of:

removing a preexisting endcap and guardrails from a series of one or more preexisting posts;

positioning a combination drill jig and locating guide at the base of the one or more posts; cutting the one or more posts above ground level into two parts using an abrasive wheel or mechanical saw, creating a top part and a bottom part of the posts;

drilling one or more through holes through the top part and bottom part of the one or more posts;

removing the combination drill jig and locating guide from the base of the one or more posts;

attaching a three sided coupling to the top part and bottom part capable of holding the top part and the bottom part of the posts together by fastening with one or more fasteners; attaching the safety guardrail apparatus of claim 3 by attaching the front plate, one or more diverters, and one or more support plates to the top part of the first post, and inserting at least one guardrail into the path defined by the diverter.

5. A safety guardrail comprising:

a front plate having an anterior surface and posterior surface;

one or more support plates connected to the posterior surface of the front plate;

one or more four-walled non-linear diverters defining a path between an open anterior end and open posterior end, the one or more diverters connected to the one or more support plates;

one or more guardrails having an anterior end and a posterior end, the anterior end of one or more guardrails located inside the path of the diverter;

one or more posts distributed in a first plane, the first post in the plane having a top part connected to the one or more diverters and the one or more support plates;

wherein the anterior end of the one or more diverters flare in a direction away from the first plane;

a coupling having a first flat part, a second flat part and a third flat part, the first flat part being perpendicularly connected to the second flat part, the second flat part being perpendicularly connected to the third flat part, the first flat part and third flat part being oriented parallel to each other;

wherein the first flat part is connected to the posterior side of the top part of the one or more posts and the third flat part is connected to the anterior side of the bottom part of the one or more posts;

wherein the one or more posts are at least partially underground, and the top half and bottom half of the one or more posts is not a continuous piece of material;

wherein the top half and the bottom half of the one or more posts are held together by the coupling.

6. The safety guardrail of claim 5, further comprising one or more rectangular bumpers attached to the posterior side of the top part of the one or more posts.

7. The safety guardrail of claim 5, wherein the bottom part of the one or more posts is affixed to the third flat part of the coupling by one or more fasteners having a first strength, and the top half of the one or more posts is affixed to the first flat part of the coupling by one or more fasteners having a second strength, the first strength being less than the second strength.

* * * * *